US008260193B2

(12) United States Patent
Littlejohn et al.

(10) Patent No.: US 8,260,193 B2
(45) Date of Patent: Sep. 4, 2012

(54) MODIFIED PLAYLISTS

(75) Inventors: Jeffrey Lee Littlejohn, Alexandria, KY (US); David C. Jellison, Jr., Ogallala, NE (US)

(73) Assignee: Clear Channel Management Services, Inc., San Antonio, TX (US)

( * ) Notice: Subject to any disclaimer, the term of this patent is extended or adjusted under 35 U.S.C. 154(b) by 0 days.

(21) Appl. No.: 13/358,581

(22) Filed: Jan. 26, 2012

(65) Prior Publication Data

US 2012/0143998 A1 Jun. 7, 2012

Related U.S. Application Data

(63) Continuation of application No. 12/968,767, filed on Dec. 15, 2010, now Pat. No. 8,107,876, which is a continuation-in-part of application No. 11/535,347, filed on Sep. 26, 2006, now Pat. No. 7,899,390.

(51) Int. Cl.
*H04H 20/74* (2008.01)

(52) U.S. Cl. ..... 455/3.02; 455/3.06; 455/556.1; 379/101.01

(58) Field of Classification Search ..... 455/45, 455/186.1, 3.06, 161.2, 3.02, 3.05, 184.1, 455/185.1, 556.1, 556.2, 90.3; 379/101.01, 379/90.01, 102.01, 102.02; 709/228, 202, 709/203, 218, 219, 231, 232, 223
See application file for complete search history.

(56) References Cited

U.S. PATENT DOCUMENTS

| | | | |
|---|---|---|---|
| 6,223,210 | B1 | 4/2001 | Hickey |
| 6,577,716 | B1 | 6/2003 | Minter et al. |
| 6,964,061 | B2 | 11/2005 | Cragun et al. |
| 7,017,120 | B2 | 3/2006 | Shnier |
| 7,346,320 | B2 | 3/2008 | Chumbley et al. |
| 7,610,597 | B1 | 10/2009 | Johnson et al. |
| 7,689,705 | B1 | 3/2010 | Lester et al. |
| 2005/0198317 | A1 | 9/2005 | Byers |
| 2007/0143466 | A1 | 6/2007 | Shon et al. |
| 2011/0125595 | A1 | 5/2011 | Neal et al. |

OTHER PUBLICATIONS

International Searching Authority/US, International Search Report in PCT/US2007/011675, Nov. 10, 2011, 3 pgs, US.

*Primary Examiner* — Sujatha Sharma
(74) *Attorney, Agent, or Firm* — Garlick & Markison; Edward J. Marshall

(57) ABSTRACT

A modified playlist can be generated by identifying gaps in a playlist, and modifying other content in the playlist to fill the gap. The gap can represent previously unfilled time, or time created by removing part or all of an item already in the playlist. One or more items of content in the playlist can be modified by lengthening or shortening one of the content items in various ways, including changing a rate of playback of some or all of the items of content in the playlist. In some instances the gap can be filled or partially filled by inserting content from another server at the time of broadcast.

26 Claims, 13 Drawing Sheets

MODIFIED PLAYLISTS

CROSS REFERENCE TO RELATED APPLICATIONS

This application is a continuation of U.S. application Ser. No. 12/968,767, entitled, "METHOD AND SYSTEM FOR SELECTIVELY BROADCASTING MEDIA," filed Dec. 15, 2010, currently pending, which is a continuation-in-part of U.S. application Ser. No. 11/535,347, entitled "METHOD AND SYSTEM FOR SELECTIVELY BROADCASTING MEDIA," filed Sep. 26, 2006, now U.S. Pat. No. 7,899,390, issued Mar. 1, 2011, each of which is incorporated herein by reference in their entirety and made part of the present U.S. Utility Patent Application for all purposes.

FIELD

The present disclosure relates to a system and method for selectively providing content.

BACKGROUND

Many broadcast stations, such as radio broadcast stations, use computers running broadcast automation software, such as the NexGen Digital™ radio broadcast automation software provided by Prophet Systems Innovation, to automate some, if not all, of an entire broadcast. Broadcast content typically includes various media events such as songs, movies, advertisements, jingles, news spots, traffic, radio host commentary, interviews, station identification, segues, beds, promos, station identification, time and temperature, voice tracks and the like.

Generally, broadcast content is stored electronically in individual files, and is compiled into a broadcast program log or playlist that may include a chronological arrangement of various types of broadcast content to create the desired listening "experience." For example, a playlist for a radio music program may include a series of songs with station identification and advertisements interspersed at various intervals.

Many broadcast stations are part of larger broadcast systems or networks that allow broadcast programs to be shared. For example, one broadcast station may host a live program, record that program, and transmit that program to another broadcast station for rebroadcast.

When networked broadcast stations share programming, content broadcast transmitted from one broadcast station may not be appropriate for another broadcast station. For example, a broadcast program may include songs, movies and/or advertisements pertinent to a particular audience and not to another audience. Or, a program from one broadcast station may be transmitted to multiple broadcast stations having diverse audiences, such as paid subscribers to an Internet-based broadcast, or to HD radio listeners, and certain content may be undesirable for that audience. There is a need, therefore, for a method and apparatus of selectively providing content.

SUMMARY

Methods and systems for selectively broadcasting media events are disclosed herein.

In various embodiments disclosed herein, a sequence of media events, which includes insertion markers indicating locations for insertion of targeted spots, is received by a content distribution (CDN) server. The CDN server also receives information associated with a user, and transmits that information to a second server. The CDN server receives, from the second server, targeted spots based on the information associated with the user, and inserts the targeted spots as indicated or directed by the insertion markers. The CDN server can stretch or compress the sequence of media events. In addition to the insertion markers, the sequence of media events may include spot blocks indicating where non-targeted spots are to be skipped by the CDN server or substitution markers indicating where targeted spots are to be substituted for non-targeted spots.

In other embodiments, a CDN server is configured to receive a sequence of media events from a first server, where the sequence can include insertion markers indicating where targeted spots are to be inserted. The CDN server can receive information associated with a user, and transmit that information to a second server. The CDN server can also obtain, from the second server, targeted media events based on the information associated with the user and, while broadcasting the sequence of media events, insert the targeted media events into the sequence as directed by the insertion markers. The CDN server can be configured to stretch or compress the sequence of media events. The CDN server can also be configured to either skip non-targeted spots as indicated by spot blocks included in the sequence of media events or substitute targeted spots for non-targeted spots as indicated by substitution markers included in the sequence of media events.

BRIEF DESCRIPTION OF THE DRAWINGS

Aspects of this disclosure will become apparent upon reading the following detailed description and upon reference to the accompanying drawings, in which like references may indicate similar elements.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

Figure 1:
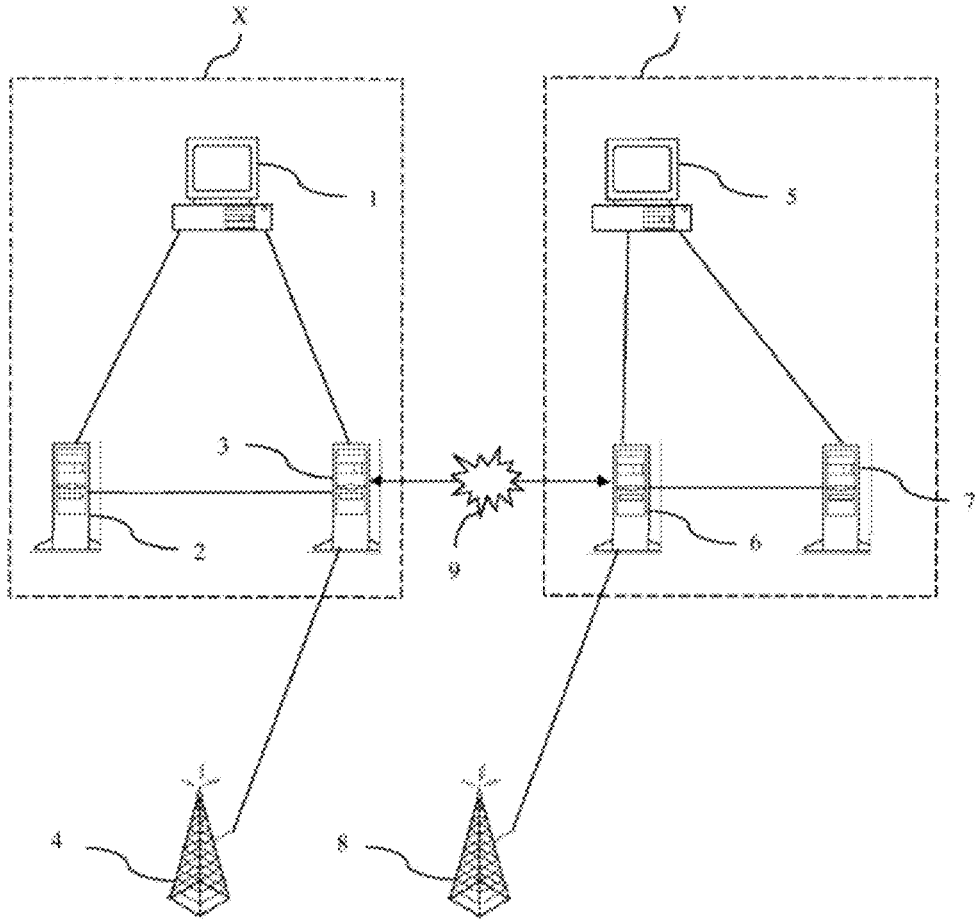
FIG. 1 depicts one embodiment of a broadcast system having a first broadcast station X and a second broadcast station Y.

A detailed description is provided primarily in the context of radio broadcasting, but those skilled in the art will appreciate that the invention is not limited to radio broadcast operations. As seen in the embodiment of FIG. 1, a broadcast station X may include a primary workstation 1 using broadcast automation software to automate broadcast operations. The primary workstation 1 may be connected to a primary file server 2 and a primary audio server 3. Another broadcast station Y may include a secondary workstation 5 also using broadcast automation software to automate broadcast operations. The secondary workstation 5 may be connected to a secondary file server 7 and a secondary audio server 6. In this embodiment, the primary audio server 3 and secondary audio server 6 are connected to antennas 4 & 8, respectively. In this embodiment, the primary audio server 3 is connected to the secondary audio server 6 through a network 9, such as the Internet or wide area network. Such connection may, of course, be direct or indirect, electrical and/or physical, and may be wired or wireless. Those skilled in the art will recognize that the primary workstation 1 and secondary workstation 5, along with their respective file servers 2 & 7 and audio servers 3 & 6, may be co-located at a broadcast station or located apart, and may, for example, serve different radio audiences.

In this embodiment, the primary and secondary workstations 1 & 5 each use NexGen Digital™ v.2.4.19.1 broadcast automation software. The primary file server 2 and primary audio server 3 connected to the primary workstation 1 may, for example, be mounted in a common rack and connected to other hardware that may be used for broadcast station operation, such as to an audio switcher, a universal power supply, digital reel-to-reel hardware, real-time editor hardware, mixing boards and the like. A similar arrangement may be provided for the secondary workstation 5, secondary file server 7 and secondary audio server 6. Those skilled in the art will recognize that the environment illustrated in FIG. 1 and described herein is not intended to limit the present invention. Indeed, those skilled in the art will recognize that other alternative hardware and environments may be used without departing from the scope of the present invention. A server computer may, for example, include a processor, a random access memory, data storage devices (e.g. hard, floppy, and/or CD-ROM disk, drives, etc.), data communications devices (e.g., modems, network interfaces, etc.), display devices, (e.g., CRT display, LCD display, etc.), and input devices (e.g., mouse pointing devices, keyboard, CD-ROM drive, etc.). A server may, for example, be attached to other devices, such as a read-only memory, a video card, a bus interface, a printer, etc. Those skilled in the art will appreciate that any combination of the above components, or any number of different combinations, peripherals, and other devices, may be used with the server. Likewise, those skilled in the art will recognize that various servers, workstations, hardware and software described herein, whether termed "file server," "audio server," "workstation," "first server," "second server," "switcher," "editor," "storage device," "broadcast automation software," "buffer," "adapter," "broadcast station" and the like, and the capabilities and features ascribed thereto, may refer to different functions, programs and/or applications of one or more computing devices in a single location or spread over multiple locations, and may be implemented in hardware, software, virtualized hardware, cloud-based processing, or some combination thereof.

In this embodiment, the primary and secondary file servers 2 & 7 may be used to store various media events, and the primary and secondary audio servers 3 & 6 may be used to mix and play media events, for example, over the air or over the Internet as a radio broadcast. Accordingly, the primary and secondary audio servers 3 & 6 may each be provided with a multi stream PCI audio adapter (not shown) designed for broadcast use and having, for example, one "record" stream input and six "play" stream outputs. Such an adapter may be any suitable adapter, and may, for example, be the model ASI6122 audio adapter from Audioscience.

Figure 2:
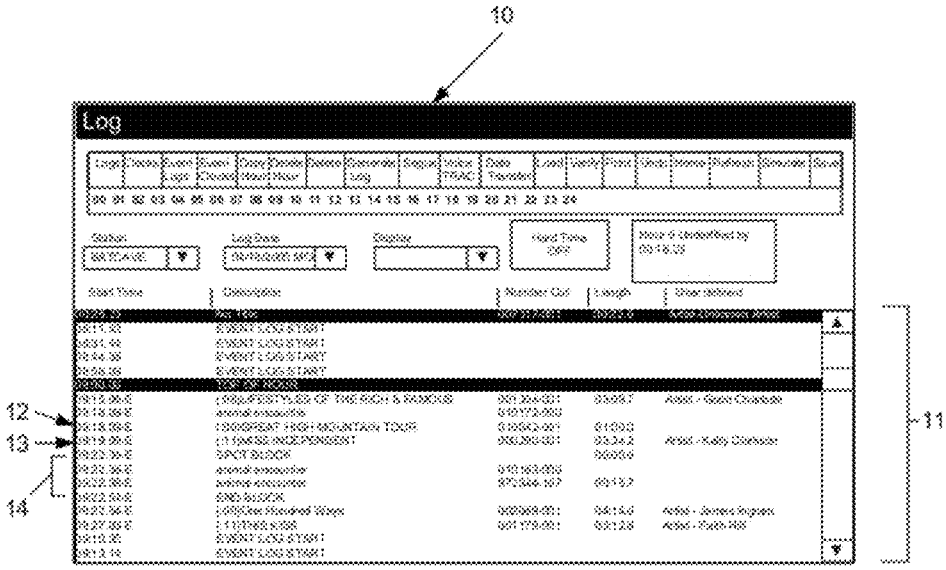
FIG. 2 depicts one embodiment of a media event log.

A user at the primary workstation 1 may create a radio broadcast program by using the broadcast automation software to arrange audio content into a log of media events. As seen in the embodiment of FIG. 2, the exemplary broadcast automation software allows a broadcast station to automate the production of a radio program through creation of a media event log 11, from which a playlist may be generated. As used herein, the terms "log" and "playlist" may be used interchangeably. As used in the claims, the term "automation playlist" includes both "log" and "playlist," and a generally connotes a sequence of media events. In the event log interface 10, a broadcaster may define, over a 24-hour period, when and how various media events will be played in order to create the radio broadcast "experience," as is known to those skilled in the art. The media event log 11 may thus generally be a time-based collection of media events arranged in playback order, and may include metadata associated with the media events, such as song title, artist, radio station identification, macros (user-defined sequences of media events) and the like. Generally, a media event log may cover a day's worth of programming, but other time periods may be used, as well, and the event log 11 may be planned and created well in advance of actual broadcast. The event log 11 may, for example, indicate to the broadcaster whether airtime has been adequately filled, and describe the type of media events to fill various day parts.

In the embodiment of FIG. 2, the media event log 11 provides a list of media events arranged according to the time during which each media event will play. In this embodiment, the event log 11 sets out an exemplary morning show radio program that includes advertisement spots and songs. For example, a one-minute long "Great High Mountain Tour" advertisement spot 12 is shown as scheduled to play at 9:18:09, followed by the "Miss Independent" song 13 by artist Kelly Clarkson, which is shown as scheduled to play at 9:19:09. Also, for example, an "animal encounter" advertisement spot 14 is scheduled to begin play at 9:22:38, and end at 9:22:54.

As is known in the art, the relationship between the media events may be defined to enhance the radio broadcast "experience." The various transitions between media events may include, for example, crossfades, overlap, clipping, ducking, and fade in and fade out. In the audio context, for example, "fading" generally refers to the process of changing the volume of a media event over time. "Fade in" and "fade out" thus generally refer to increasing and decreasing, respectively, the volume of a media event over time, and "cross fading" generally refers to simultaneously fading out the end of one media event, while fading in the beginning of the next media event. "Fading" is commonly done at the beginning and end of a media event, but may be accomplished during other portions of a media event, as well. "Clipping" generally refers to the process of excluding a portion of a media event during playback, such as the beginning or end of a song or video element. "Ducking" generally refers to reducing the volume level of background audio while another media event, such as a voice track, is playing. "Overlap" generally refers to simultaneous performance of media events.

So defined and arranged, the media events of such a log, or playlist, may be played in real-time as, for example, an on-air broadcast to provide the radio broadcast "experience." With reference to FIG. 1, the broadcast automation software running on the primary workstation 1 directs retrieval of the media events listed in the playlist from the primary file server 2, and directs the primary audio server 3 to mix and play the media events as they appear in the media event log or playlist. The primary audio server 3 may play the media events for broadcast via antenna 4. Those skilled in the art will recognize that broadcast could easily be over the Internet or some other network. Those skilled in the art will appreciate that the term "broadcast" includes transmission of media from one to many, e.g., from a broadcast station or network of broadcast stations to a consuming audience, by any transmission medium.

Figure 3:
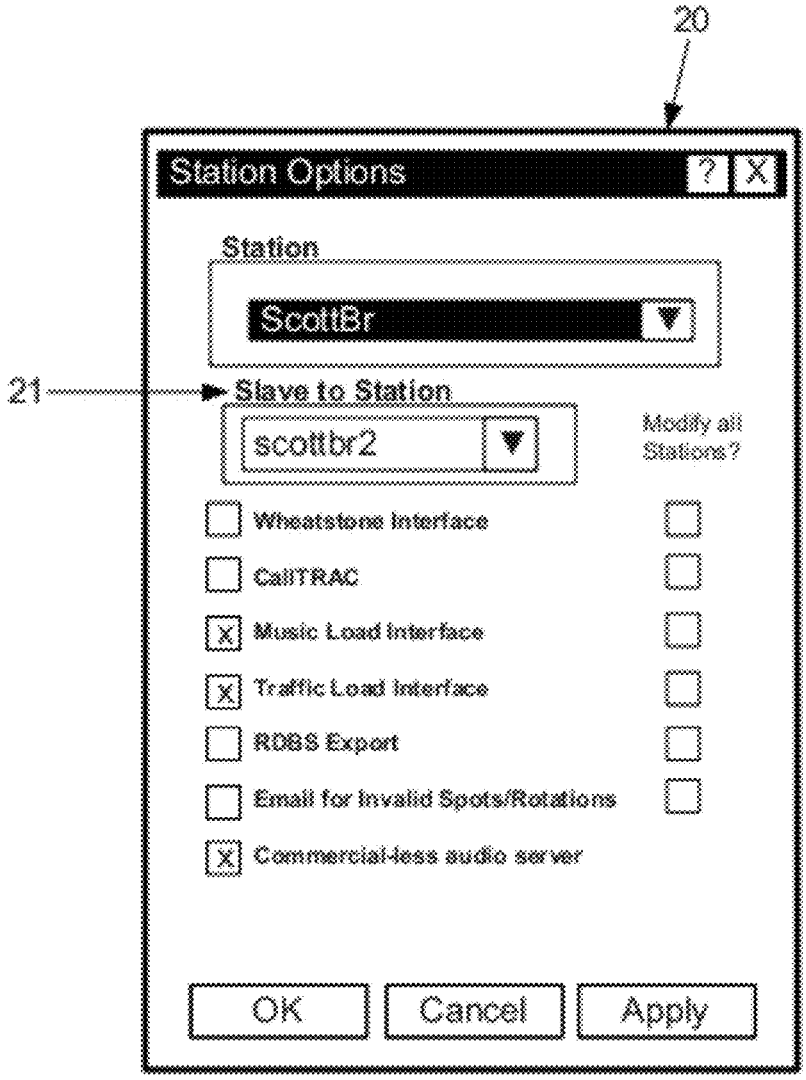
FIG. 3 depicts an embodiment of a user interface that may be provided by broadcast automation software for establishing the relationship between two broadcast stations.

In this embodiment, the secondary audio server 6 may be configured to function as a slave to the primary audio server. Multiple secondary audio servers can be configured to function as slaves to a single primary audio server. With reference to FIGS. 1 and 3, a user at the secondary workstation 5 may establish the relationship 21 between the secondary audio server (represented by the "Commercial-less Audio Server" in the list of stations) and primary audio server (represented by the "scottbr2" station) through a user interface 20 that may be provided by the broadcast automation software running on the secondary workstation 5. Thus, in addition to broadcasting the media events via antenna 4, the primary audio server 3 may also play the media events directly to the secondary audio server 6. Such play may be in real-time. Specifically, the primary audio server 3 may play through an output of its audio adapter the media events into the input of the secondary audio server's audio adapter. The secondary audio server 6 store the media stream in a buffer until directed by the secondary workstation to start playing the buffered media as, for example, an over-the-air broadcast via antenna 8. Those skilled in the art will appreciate that the buffer may be any suitable computer-readable medium.

Figure 4:
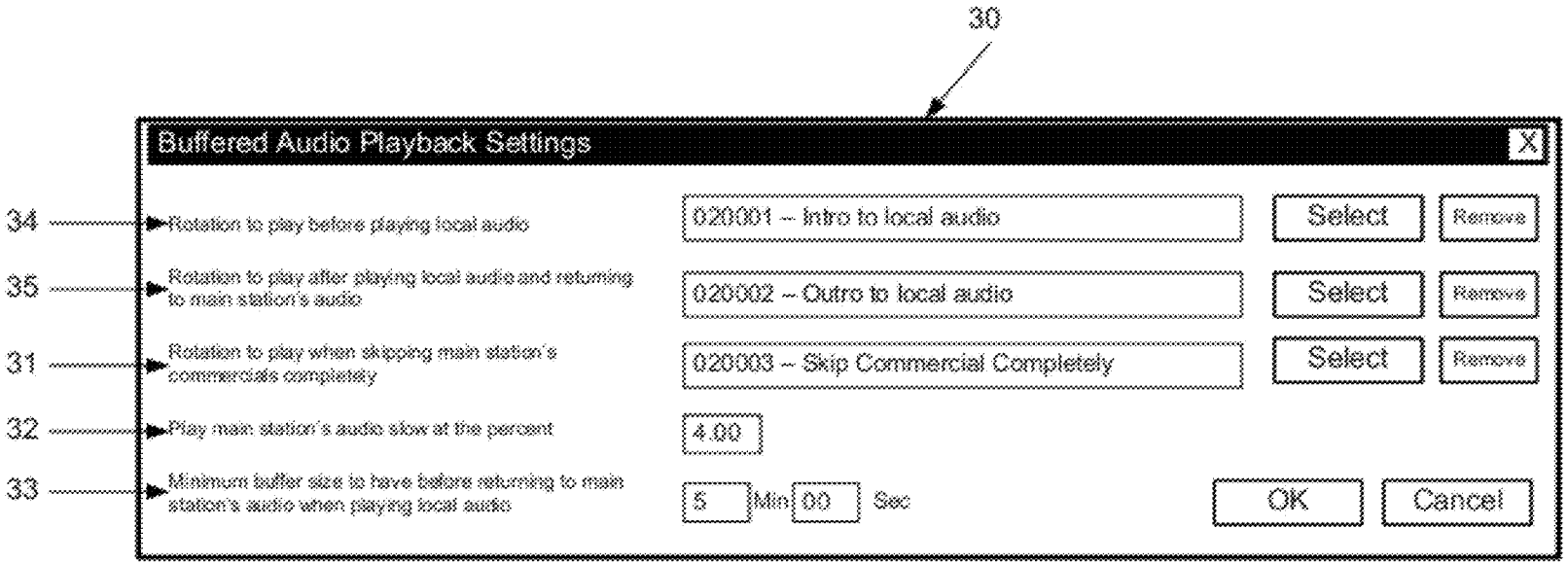
FIG. 4 depicts an embodiment of a user interface that may be provided by broadcast automation software for configuring playback of media events from a buffer.

In this embodiment, when playing media events from the secondary audio server 6 buffer, various undesired media events may be skipped. For example, it may be desired to play a rotation in which all of the advertisements are skipped. As seen in the embodiment of FIG. 4, the broadcast automation software running on the secondary workstation may accordingly provide a user interface 30 to permit that rotation 31 to be specified.

Figure 5:
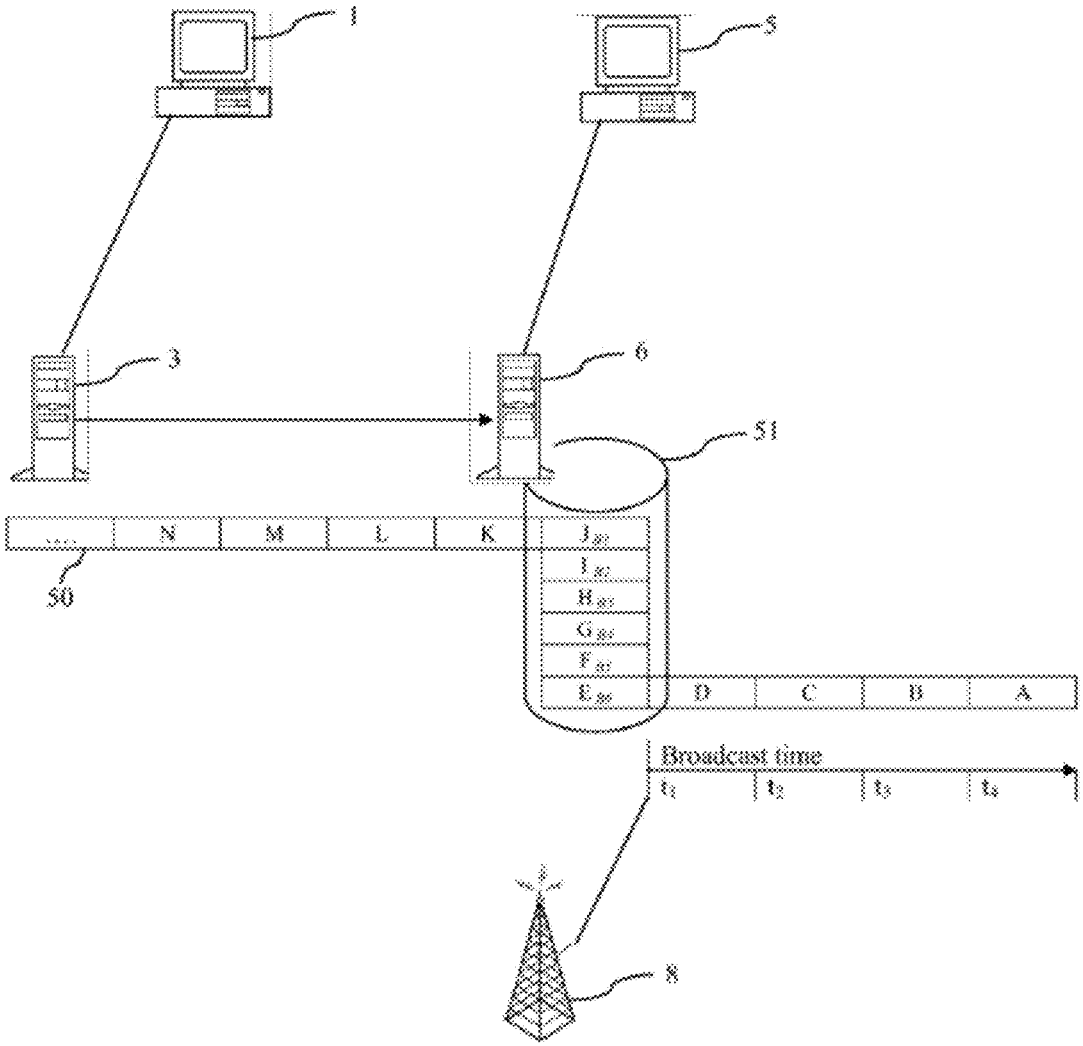
FIG. 5 depicts playing media events from a first audio server into the buffer of a second audio server, and broadcasting those media events from the second audio server.

With reference to the embodiment of FIG. 5, the primary audio server 3 may play a sequence 50 of media events A, B, C, D, . . . in real time into the buffer 51 of the secondary audio server 6 (the file servers 2 and 7 of FIG. 1 are not shown here). That is, the sequence 50 of media events may be streamed from the primary audio server 3 to the buffer 51, and after a portion of that sequence 50 has been stored in the buffer 51, the sequence 50 of media events may be broadcast from antenna 8 at broadcast time $t_1$ from the secondary audio server 6 on a first-in first-out basis. Generally, amount of buffer $B_1$ . . . $B_6$ may be specified to be a certain duration of real-time media event play. Use of the buffer 51 allows the playlist of media events to be altered prior to broadcasting, as discussed in further detail below.

Figure 6:
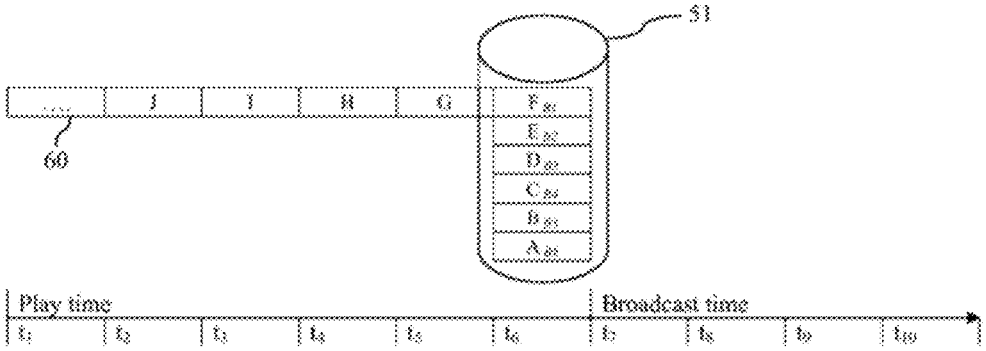
FIG. 6 depicts playing media events from a first audio server into the buffer of a second audio server at time $t_1$ prior to broadcasting.

In one embodiment, the primary audio server 3 and the secondary audio server 6 may be scheduled to begin broadcasting the same play list of media events at the same time. The primary audio server 3 may, for example, broadcast the playlist of media events to one audience, and the secondary audio server 6 may broadcast an advertisement-free version of that playlist to another audience. The primary audio server 3 may begin streaming 60 the media events, in playlist sequence, into the buffer 51, as seen with reference to FIG. 6. If, for example, a buffer of six minutes $B_1 \ldots B_6$ is desired, the primary audio server 3 may begin playing the stream 60 of media events A, B, C, . . . into the buffer six minutes (at time $t_1$) before the scheduled broadcast time $t_7$. Thus, at the broadcast time $t_7$, the buffer 51 will contain six minutes-worth of audio.

Figure 7:
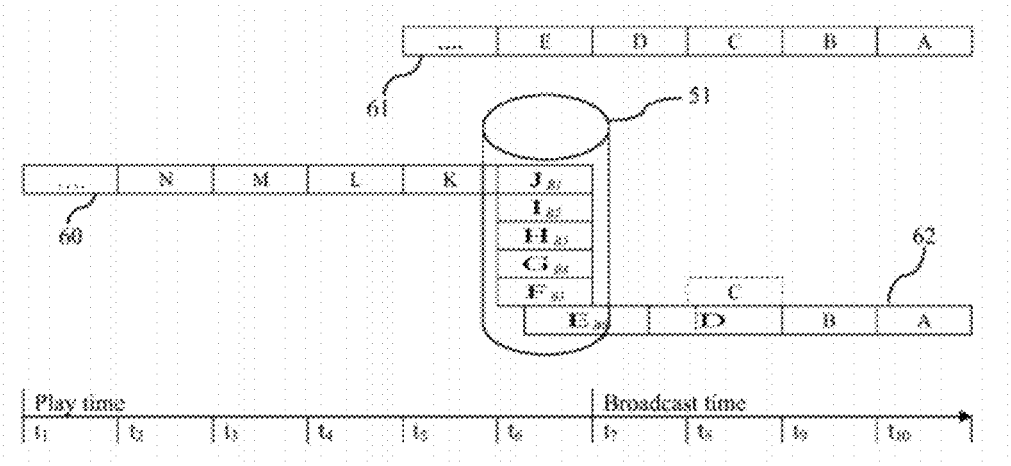
FIG. 7 depicts the media events of the embodiment of FIG. 6 broadcast from both the primary audio server and secondary audio server starting at broadcast time $t_7$ and continuing through time $t_{10}$, the media events also played from the primary audio server to the buffer of a second audio server, where broadcast from the second audio server involves skipping a media event and stretching subsequent media events while broadcasting to compensate for such skipping.

Turning to FIG. 7, broadcast of stream 61 of media events from the primary audio server 3 and broadcast of stream 62 from the secondary audio server 6 may be scheduled to begin at time $t_7$. In FIG. 7, broadcast has begun and has continued through time $t_{10}$. During that time, the primary audio server 3 may continue to play the stream 60 of media events into the buffer 51. As noted above, the primary audio server 3 may be provided with an audio adapter that allows multiple output streams 60 & 61.

In this embodiment, the user has configured the broadcast automation software of the secondary workstation 5 to instruct the audio server 6 to identify and not play advertisement spots. In the embodiment of FIG. 2, for example, spots to be skipped may be marked by the primary audio server with special markers that are displayed in the media event log 11 as "spot blocks," as with the animal encounter spot 14. According to that embodiment, the secondary audio server 6 may then detect those spot blocks and skip the spot or spots marked by the spot blocks.

In the embodiment of FIG. 7, spot C may be an advertisement spot. Spot C may be desired in the media event stream 61 from the primary audio server 3, but undesired in the media event stream 62 from the secondary audio server 6. Accordingly, spot C may be identified and not played from the buffer, and the secondary workstation's 5 broadcast automation software may instruct the secondary audio server 6 to play media event D immediately after playing media event B. Removal of spot C from the rotation, however, shortens the scheduled play list by some amount of time, i.e., the buffer amount is "used up" by skipping media events. To fill that airtime gap, the broadcast automation software may instruct the audio server 6 to slow down (stretch out) playback of one or more, or all, subsequent spots. In this embodiment, the user may configure the broadcast automation software to instruct the secondary audio server 6 to immediately play media event D after media event B and stretch, i.e., slow down, the subsequent media events D, E, F, . . . . As seen in FIG. 4, for example, the user has specified a stretch percentage 32 of 4%, and in this embodiment may stretch playback by up to 20%. Stretching subsequent songs by 4%, for example, may fill an additional 2.4 minutes of airtime per hour. In this embodiment, such stretching may be accomplished, as is known in the art, without altering the pitch of subsequent spots to avoid, for example, "draggy turntable" voices. Those skilled in the art will appreciate that other stretching and/or squeezing ratios may be applied. Alternatively, the broadcast automation software may be configured to instruct the audio server 6 to stretch out playback of only certain spots, for example, only media events D and E, as may be needed to fill airtime gap left by removal of spot C. In this embodiment, such stretching may be utilized for as long as may be needed to re-fill the buffer 51 to a minimum amount of media event play time. That is, media events in the media stream 62 may be played out from the buffer 51 more slowly than the media events of the stream 60 are played from the primary audio server 3 into the buffer 51, and the difference in play rate results in re-filling the buffer 51.

Referring generally to the embodiment of FIG. 7, for example, it may be that media events A and B are songs, media event C is an advertisement spot, and media events D, E and F are songs (the remaining media events may be, in this example, of various types). In this example, each media event may be one minute long. Playback of songs A . . . F will require 6 minutes of airtime. If broadcast is scheduled to begin from the primary audio server 3 and from the secondary audio server 6 at the top of the 9 a.m. hour (09:00:00), and a buffer of six minutes is required, the primary audio server 3 may begin playing the stream 1 of media events into the buffer 51 at 08:54:00, as described above in connection with the embodiment of FIG. 6. Thus, at broadcast time 09:00:00 ($t_7$), media events A . . . F will be stored in the buffer 51 and ready for broadcast. In this embodiment, therefore, both the primary audio server 3 and the secondary audio server 6 will begin their broadcast at 09:00:00 with song A and followed by song B. Immediately after song B finishes playing, the primary audio server 3 will begin playing advertisement spot C. The secondary audio server will, however, remove advertisement C from the playlist rotation (as shown by the dash-marked "times lot" C), and begin playing song D immediately after playing song B. Removal of advertisement C shortens that airtime play of media events A . . . F from the secondary audio server by one minute. To fill that airtime gap, and "catch up" to the broadcast 61 from the primary audio server 3, the secondary audio server 6 may stretch songs D, E and F to fill that space, so that the broadcast 62 from the secondary audio server 6 is substantially synchronous with the broadcast 61 from the primary audio server 3 by the time song F begins to play at 09:06:00. As noted above, of course, such stretching may be spread out over fewer or additional subsequent spots or all subsequent spots. Those skilled in the art will recognize that such stretching may, for example, be delayed until later in the playlist, or may be limited to song D. Generally, immediately playing song D after song B with or without stretching out one or more subsequent spots may draw down the amount of media event playtime stored in the buffer. In various embodiments, songs A, B, C, and D need not be discreet recordings; rather they can be cue points at which time the system takes action to delete or replace appropriate content pieces or segments.

Figure 8:
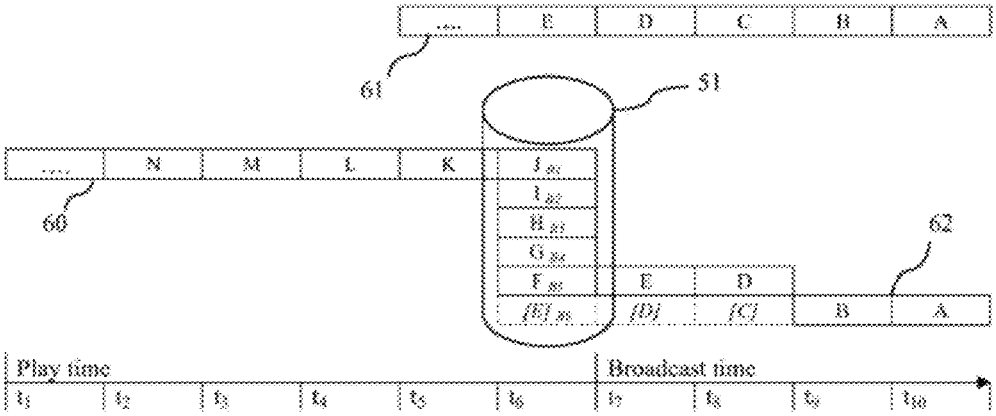
FIG. 8 depicts the media events of the embodiment of FIG. 6 broadcast from both the primary audio server and secondary audio server starting at broadcast time $t_7$ and continuing through time $t_{10}$, the media events also played from the primary audio server to the buffer of a second audio server, where broadcast from the second audio server involves skipping a media event and broadcasting media events subsequent to the skipped media event without stretching the subsequent media events.

Those skilled in the art will also recognize that stretching may not be used at all. In the embodiment of FIG. 8, spot C may be removed and songs D, E, F . . . may be played immediately after song B without stretching, and the buffer amount may be accordingly reduced to five minutes of airtime ($B_1 \ldots B_5$). The bracketed media event designations [C], [D] and [E] in the units marked by dashed lines illustrate the sequence of media events that would exist without removal of spot C.

Accordingly, an appropriate buffer may be established and maintained at a level sufficient to provide a reserve of media events to fill airtime gaps. For example, a minimum buffer size of five minutes may be sufficient to cover typical advertisement spots if stretching is used. F or longer station breaks, such as for news, a longer buffer may be required, and may range, for example, between 7.5 minutes and 14 minutes. In the embodiment of FIG. 4, for example, the minimum buffer size 33 is set at five minutes.

Also, the broadcast 62 from the secondary audio server 6 may be supplemented from a secondary playlist. A user at the secondary workstation 6 may create a secondary log or playlist of media events suitable for the intended audience of the secondary broadcast station. The secondary log or play list may be created using the automation broadcast software to, for example, create a clock with empty song slots, define a music load format for the station (such as "R&B"), based on the music load format generate a log of music similar to the media event log 11 of FIG. 2, and load the music from the secondary file server 7 to the secondary audio server 6. Those skilled in the art will appreciate that the secondary play list may comprise a single type of media events or may comprise a variety of types of media events, such as songs, news and advertisements pertinent to the secondary station's broadcast audience, station identification, radio personality commentary and the like.

Figure 9:
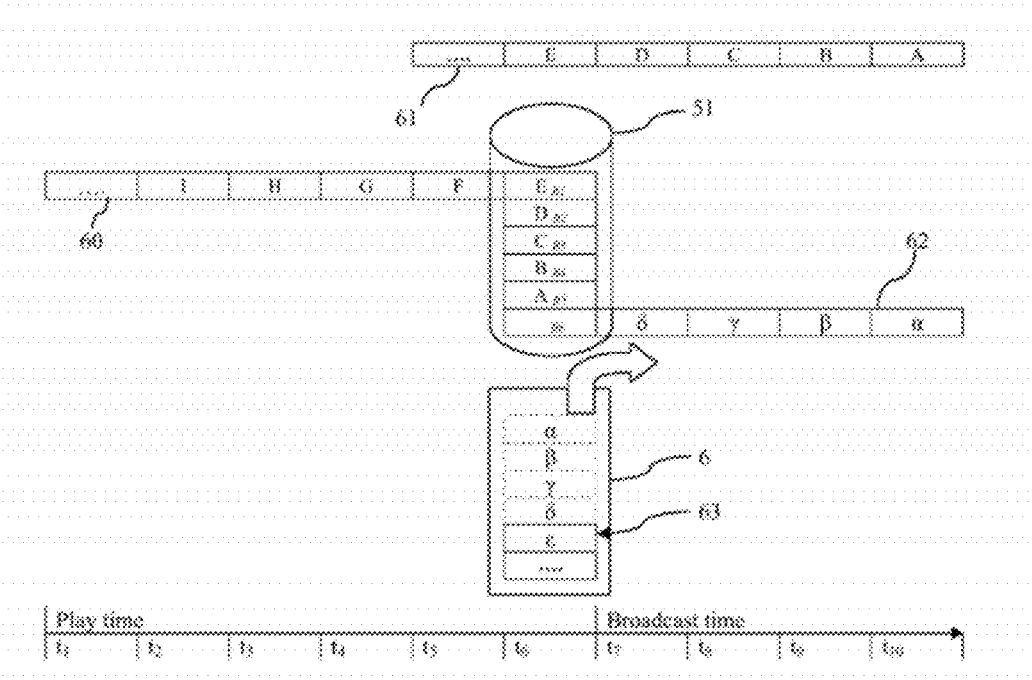
FIG. 9 depicts the media events of the embodiment of FIG. 6 both broadcast from the primary audio server and played into the secondary audio server starting at broadcast time $t_7$, and broadcasting a secondary play list from the secondary audio server at broadcast time $t_7$ until the buffer is sufficiently full to begin broadcasting the media events stored.

In one embodiment, with reference to FIG. 9, the primary audio server 3 may begin broadcasting the primary playlist at 09:00:00 (time t7) while simultaneously playing the primary playlist to the buffer 51 of the secondary audio server 6. The secondary audio server 6 may broadcast from a secondary playlist 63 of spots $\alpha$, $\beta$, $\gamma$, $\delta$, $\epsilon$, . . . at 09:00:00 while an adequate reserve $B_1 \ldots B_6$ of the media events, from the primary audio server 3 is being stored in the buffer 51, and then switch over to broadcast of the buffered primary playlist when the buffer requirements $B_1 \ldots B_6$ are met. Thereafter, the secondary audio server 6 may remove undesired media events as described above.

Figure 10:
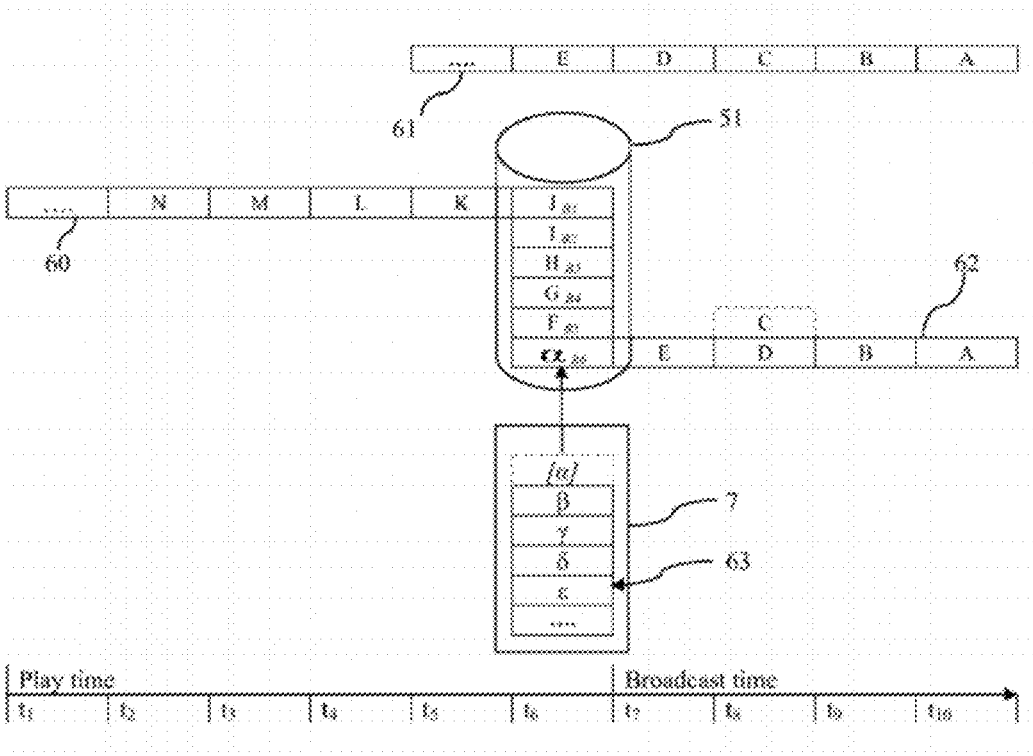
FIG. 10 depicts the media events of the embodiment of FIG. 6 broadcast from both the primary audio server and secondary audio server starting at broadcast time $t_7$ and continuing through time $t_{10}$, the media events also played from the primary audio server to the buffer of a second audio server, where broadcast from the second audio server involves skipping a media event, playing a subsequent media event and adding to the buffer a media event from an alternative play list.

In the embodiment of FIG. 10, the secondary audio server 6 may refill the buffer with one or more media events from the secondary playlist 63, thus drawing media events from the secondary file server 7. For example, song a may be added to the buffer, and, if necessary, stretched (or squeezed) to fill the airtime that would have been filled by advertisement C. Alternatively, songs a and 13 (or other media events from play list 63) may both be added to the buffer (not shown), and squeezed to fill the airtime. Those skilled in the art will recognize that songs D, E, . . . may also be squeezed or stretched as may be appropriate to accommodate media events from the secondary play list 63, and that additional buffered media events may be removed from or used to fill the airtime as the case may be if, for example, such squeezing (or compressing) and/or stretching of songs D, E, . . . is inappropriate. Additionally, those skilled in the art will recognize that media events from the secondary play list 63 may be added to the buffer to supplement any part of the broadcast 62, including supplementation immediately after song B.

Also, if during broadcast the amount of buffered media becomes inadequate to meet airtime fill requirements, the secondary playlist 63 may be played until the buffer requirements are once again met. F or example, if the buffer has less than 15 seconds of media event play time stored, the secondary playlist 63 may be played until some threshold buffer requirement is met. Alternatively, if the primary playlist 61 is exhausted, the secondary audio server 6 may switch back to broadcasting the secondary playlist 63.

Figure 11:
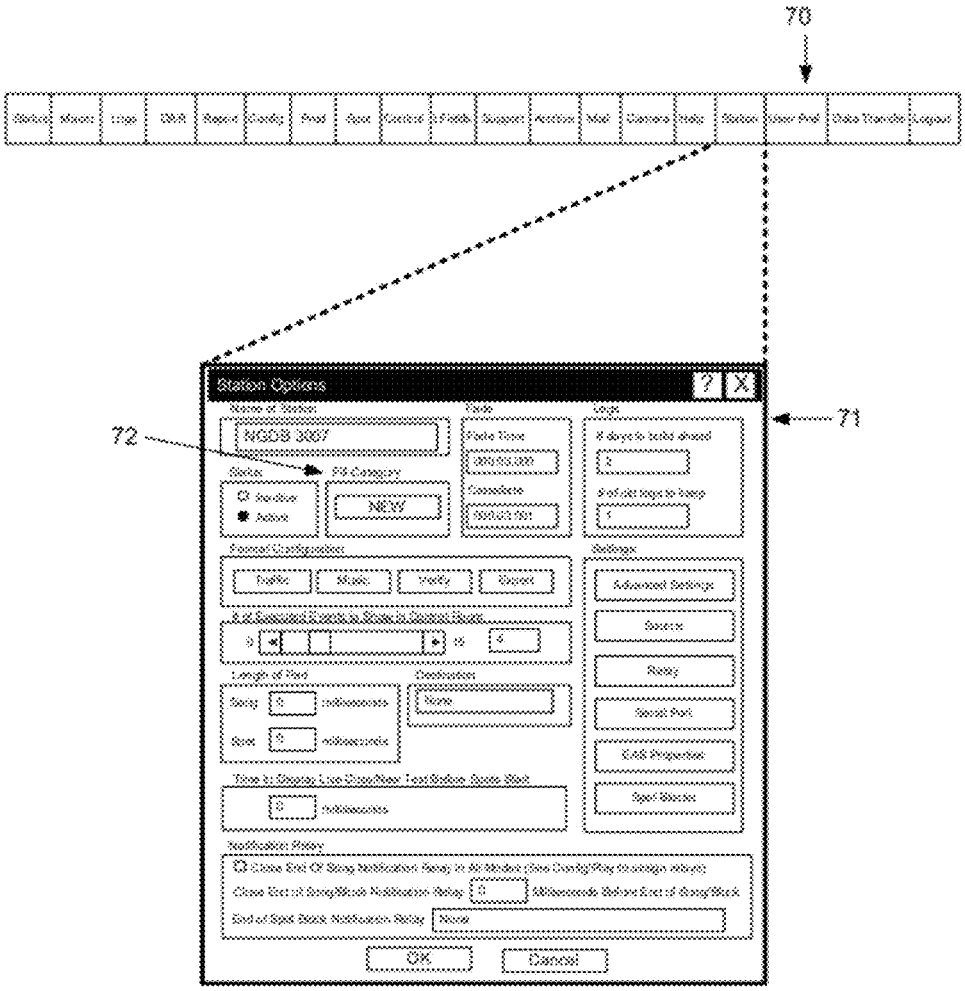
FIG. 11 depicts an embodiment of a user interface provided by broadcast automation software for establishing a fill category for a broadcast station.

If the secondary playlist 63 is also exhausted, the secondary audio server 6 may play filler material established as appropriate for that station. In the embodiment of FIG. 11, for example, the broadcast automation software may allow a user to create a category of songs that may be used to fill gaps in airtime. The user may do so by accessing the configuration menu 70 of the exemplary broadcast automation software installed on the secondary workstation 5, and selecting the "station" option to bring up an interactive dialog box 71 that allows the user to change the fill category 72. The category of fill media events selected may be valid for that station, e.g., "R&B" filler material for an "R&B" station format. Those skilled in the art will appreciate that a secondary play list is not required, and that random filler material may just as easily be used.

Those skilled in the art will recognize that the transition between media events of the secondary playlist and media events of the primary playlist may be defined in a manner noted above. For example, the last media event played from the secondary playlist may cross fade into the first media event played from the primary playlist. In the embodiment of FIG. 4, for example, a user may establish the rotation 34 to play immediately before transitioning from the primary play list to the secondary playlist, and may establish the rotation 35 to play in transitioning from the secondary playlist to the primary playlist. In the embodiment of FIG. 4, the user has established "intros" to segue into a media event from the secondary play list and "outros" to segue out of that media event.

In one embodiment, the broadcast automation software installed on the secondary workstation may provide an indication to the user of the status of the secondary audio server's buffer, such as how full the buffer is, which portion of the primary playlist is stored in the buffer, the types of media events stored in the buffer and the like. The broadcast automation software may also allow a user to "jump ahead" in the buffer to, for example, skip portions of the playlist. The broadcast automation software may allow a user to rearrange the portions of the play list stored in the buffer. Thus, the play list does not necessarily have to be played from the buffer on a first-in first-out basis. Additionally, the broadcast automation software may allow a user to "dump" buffered media events into a media events log of the secondary station, and update the playback times in that media events log based on the buffer information. Furthermore, those skilled in the art will recognize that the secondary audio server 6 may output more than one stream from buffer 51, and may separately manipulate those streams as discussed herein. For example, one stream may be entirely advertisement free, and another stream may have advertisements inserted from a secondary play list.

Figure 12:
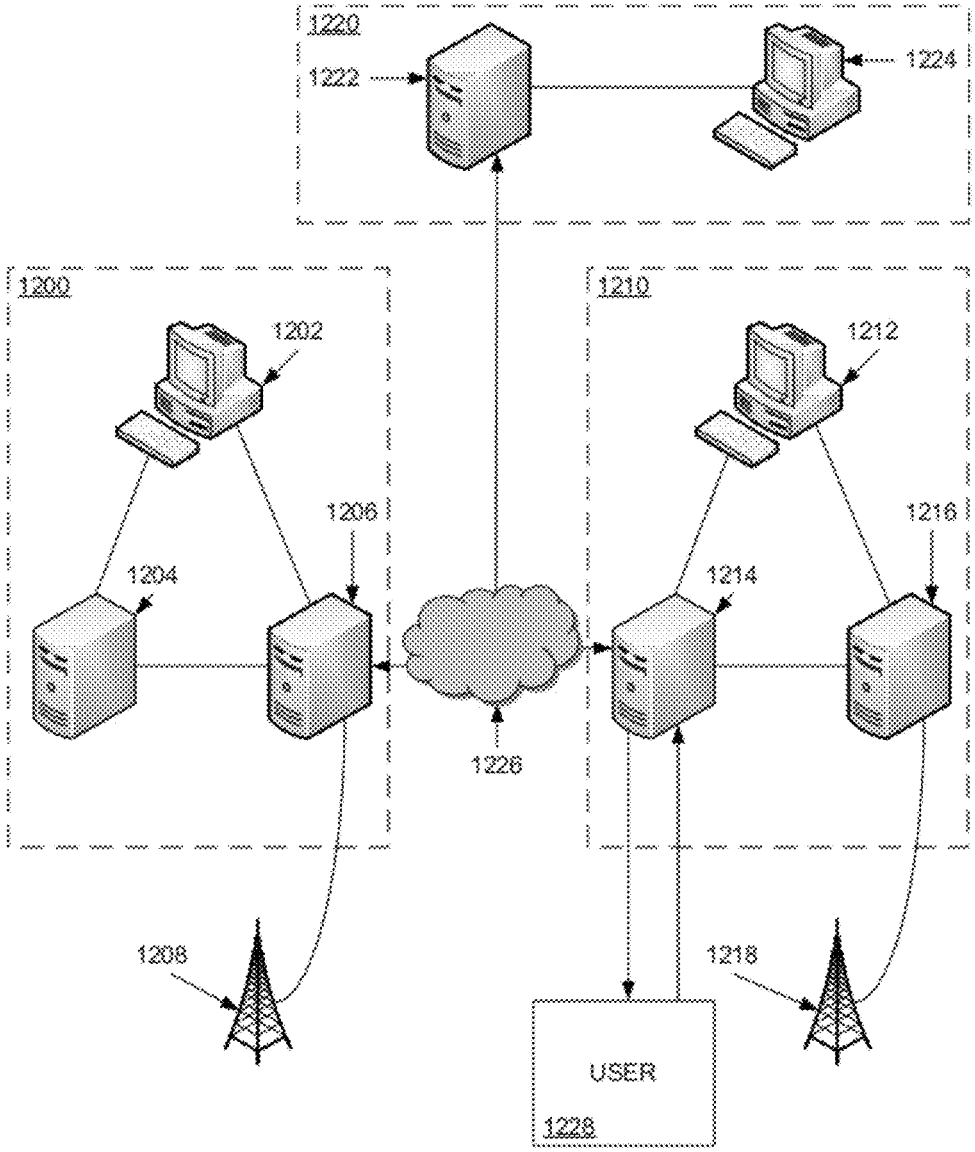
FIG. 12 depicts embodiments of a broadcast system having a first broadcast station and a second broadcast station in communication with a third audio server.

As seen in FIG. 12, a broadcast station 1200 may include a primary workstation 1202 using broadcast automation software to automate broadcast operations. The primary workstation 1202 may be connected to a primary file server 1204 and a primary audio server 1206. Another broadcast station 1210 may include a secondary workstation 1212 also using broadcast automation software to automate broadcast operations. The secondary workstation 1212 may be connected to a secondary file server 1214 and a secondary audio server 1216. In this embodiment, the primary audio server 1206 and secondary audio server 1216 are connected to antennas 1208 & 1218, respectively.

The primary audio server 1206 is connected to the secondary audio server 1216 through a network 1226, such as the Internet or wide area network. Such connection may be direct or indirect, electrical and/or physical, and may be wired or wireless. The primary workstation 1202 and secondary workstation 1212, along with their respective file servers 1204 & 1214 and audio servers 1206 & 1216, may be co-located at a broadcast station or located apart, and may, for example, serve different radio audiences.

A tertiary station 1220 may be used to store and transmit various media events upon request from the first or second stations 1200 or 1210. The third station can include a tertiary workstation 1224 and a third file server 1222. The primary workstation 1202, secondary workstation 1212, and tertiary workstation 1224, along with their respective file servers 1204, 1214, 1222 and audio servers 1206 & 1216, may be co-located at a broadcast station or located apart, and may, for example, serve different radio audiences. For example, the second broadcast station 1210 can be part of a content distribution network (CDN), such that the file server 1214 is a CDN file server and the audio server 1216 is a CDN audio server.

The tertiary file server 1222 can be used to provide targeted media events upon request from primary or secondary file servers 1204 and 1214. The second file server 1214 can be configured to request information associated with a user 1228. The information associated with the user can include user demographics or user preferences. User demographics may include, but are not limited to, age, gender, geographic location, interests, education, income, and media format. The information, once received by the secondary file server 1214, can be further transmitted to the tertiary file server 1222 via the network 1226. The tertiary file server can use the information associated with the user 1228 to retrieve media events that are targeted to users sharing at least some of the user's 1228 demographic information. The targeted media events, once retrieved by the tertiary file server 1222, can be transmitted to the secondary file server 1214 via the network 1226, where they can be inserted into the sequence of media events that is broadcast from station 1210.

Figure 13:
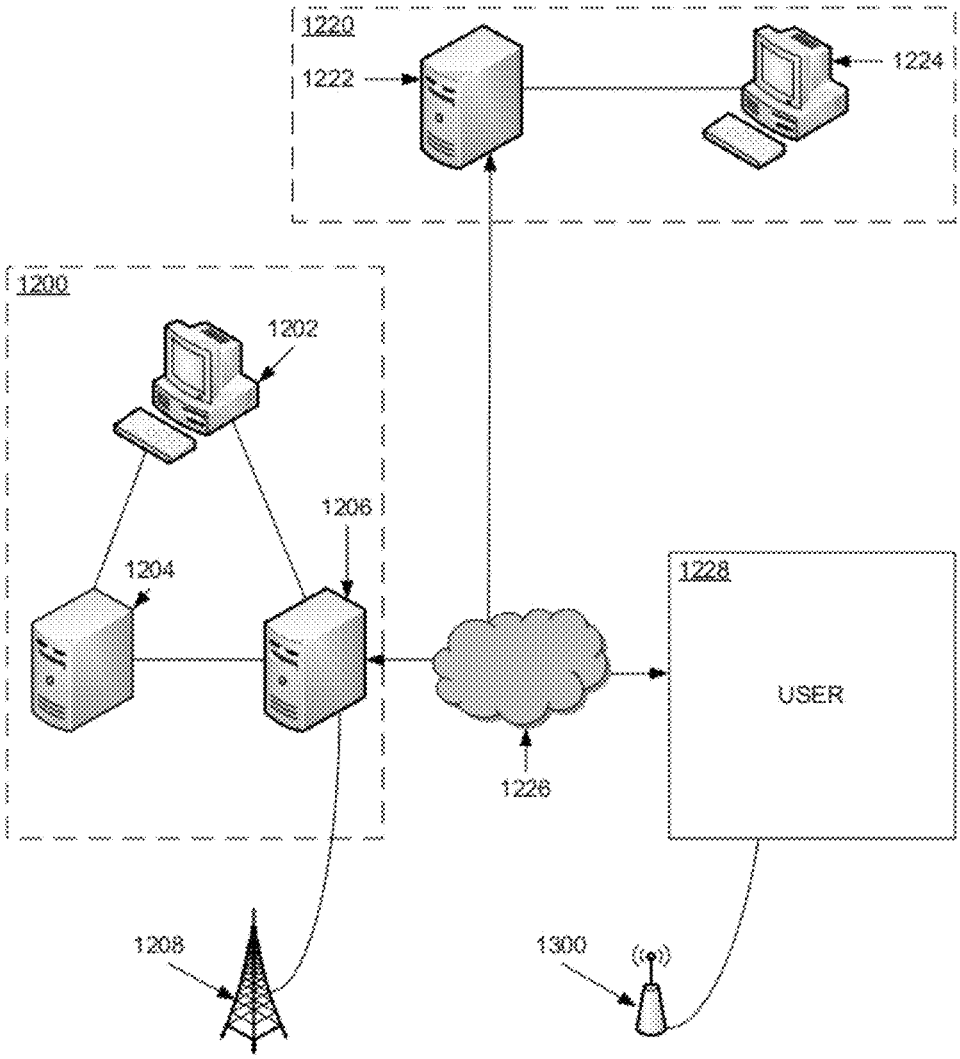
FIG. 13 depicts embodiments of a broadcast system having a first broadcast station and a media device in communication with a third audio server.

As seen in FIG. 13, the user 1228 can be the transmission target of the primary audio server 1206, rather than another broadcast station. The user 1228 could be a media provider, such as an Internet radio station or a music on demand Web site, a CDN-hosted web site, or any other Web site that provides media. Alternatively, the user 1228 can be a consumer or at least one consumer device, including, but not limited to, such devices as computers, appliances, personal digital assistants (PDAs), wrist watches, stand-alone Internet radios, set top boxes, and television systems. The user, be it a media provider or consumer device, can be located within a receiver. In addition to receiving sequences of media events from the primary audio server 1206, transmitting information associated with the user to the tertiary file server 1222, and receiving targeted media events from the tertiary file server 1222, the user 1228 can be configured to compile and broadcast a sequence of media events via a transmitter, which can include, but is not limited to, a wireless transmitter 1300.

Figure 14:
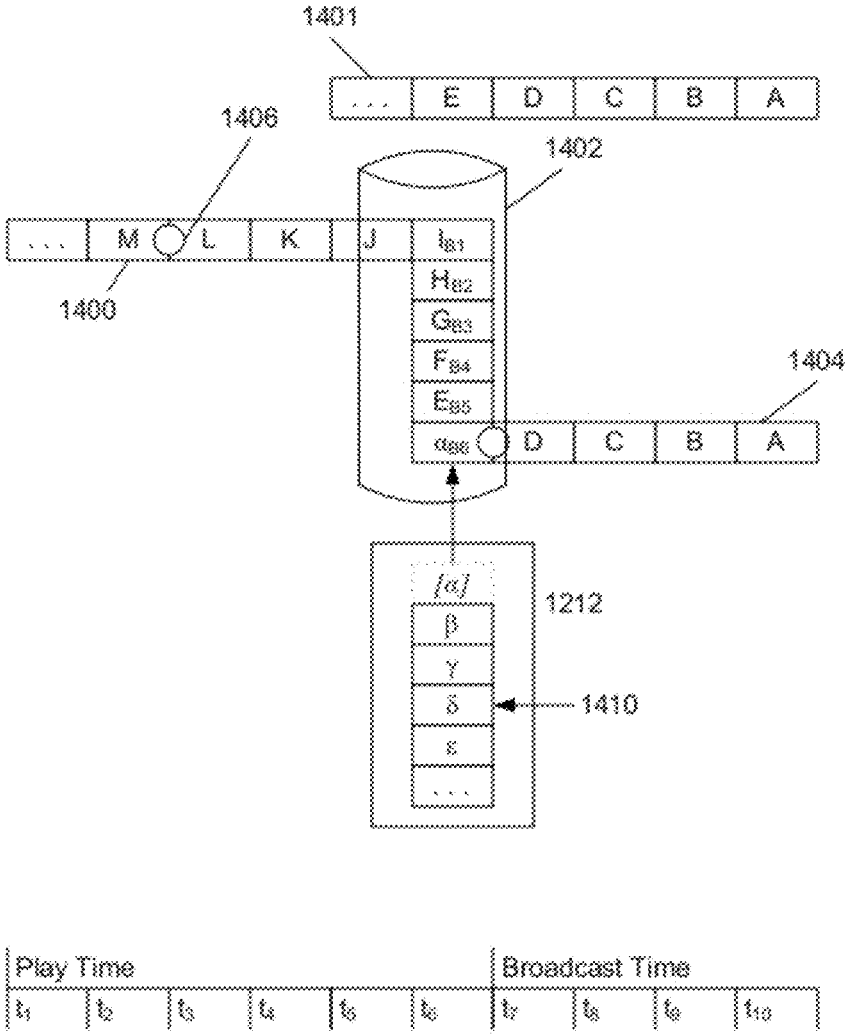
FIG. 14 depicts playing media events, some of which contain insertion markers, from a first audio server into the buffer of a second audio server, inserting media events from a third audio server at the direction of the insertion markers, and broadcasting the media events from the second audio server.

Turning to FIG. 14, the broadcast of stream 1401 of media events from the primary audio server and broadcast of stream 1404 from the secondary audio server may be scheduled to begin at time $t_7$. In FIG. 14, broadcast has begun and has continued through time $t_{10}$. During that time, the primary audio server may continue to play the output stream 1400 of media events into the buffer 1402. As noted above, the primary audio server 3 may be provided with an audio adapter that allows multiple output streams 1400 & 1401.

In one embodiment, the user has configured the broadcast automation software of the secondary workstation 1212 to instruct the audio server to insert targeted media events. Types of targeted media events can include, but are not limited to, targeted content, targeted spots or targeted advertisement spots. Content can include, but is not limited to radio programs, songs, traffic and weather reports. For example, points in the output stream 1400 at which targeted media events are to be inserted may be marked by the primary audio server with special markers that are displayed in the media event log as "insertion markers" 1406. The insertion markers 1406 can include indications of the preferred time length of inserted media events; the insertion markers 1406 can also indicate the maximum or minimum allowable time length for inserted media events. According to various embodiments, the secondary audio server can detect those insertion markers 1406 and insert a targeted spot or spots at the point in the output 1400 marked by the insertion markers 1406. Points in the output stream 1400 may also be marked with special markers displayed in the media event log as "substitution markers." These substitution markers would indicate that a marked media event is to be skipped, and a targeted media event, such as a targeted spot, is to be inserted in place of the marked media event.

The broadcast of output stream 1404 from the secondary audio server may be supplemented from a secondary playlist 1410 of media events, which can include targeted media events. A user at the secondary workstation 1212 may use a secondary log or playlist 1410 of media events that can include targeted media events that have been retrieved using the tertiary server. The secondary log or playlist 1410 may be created by sending information associated with a user to a tertiary server and retrieving, through the use of a tertiary server, a log of targeted media events, similar to the media event log 11 of FIG. 2, which can be loaded from the tertiary server to the secondary audio server.

In some embodiments, the secondary file server may load the targeted media events from the tertiary server and create a log of the targeted media events, which can then be loaded to the secondary audio server. The secondary audio server can be configured to insert a media event from the secondary playlist 1410 into the secondary output stream 1404 when an insertion marker 1406 is encountered in the output stream 1400. The secondary play list may comprise a single type of targeted media event or may comprise a variety of types of targeted media events, such as songs, news and advertisements pertinent to the secondary station's broadcast audience, station identification, radio personality commentary and the like.

In addition, the output stream 1400 can include spot blocks, as shown in FIG. 7, to enable the skipping of media events as directed by the spot blocks. The media events marked by spot blocks can include non-targeted spots, which can also be advertisement spots. Use of insertion markers can enable an output stream 1400 including non-targeted spots to be converted into an output stream 1404 including at least some targeted spots Likewise, even if some spots are included in output stream 1404, including targeted spots, insertion markers can allow additional targeted spots can be added, targeted and non-targeted spots to be rearranged, and other similar modifications to be performed.

Figure 15:
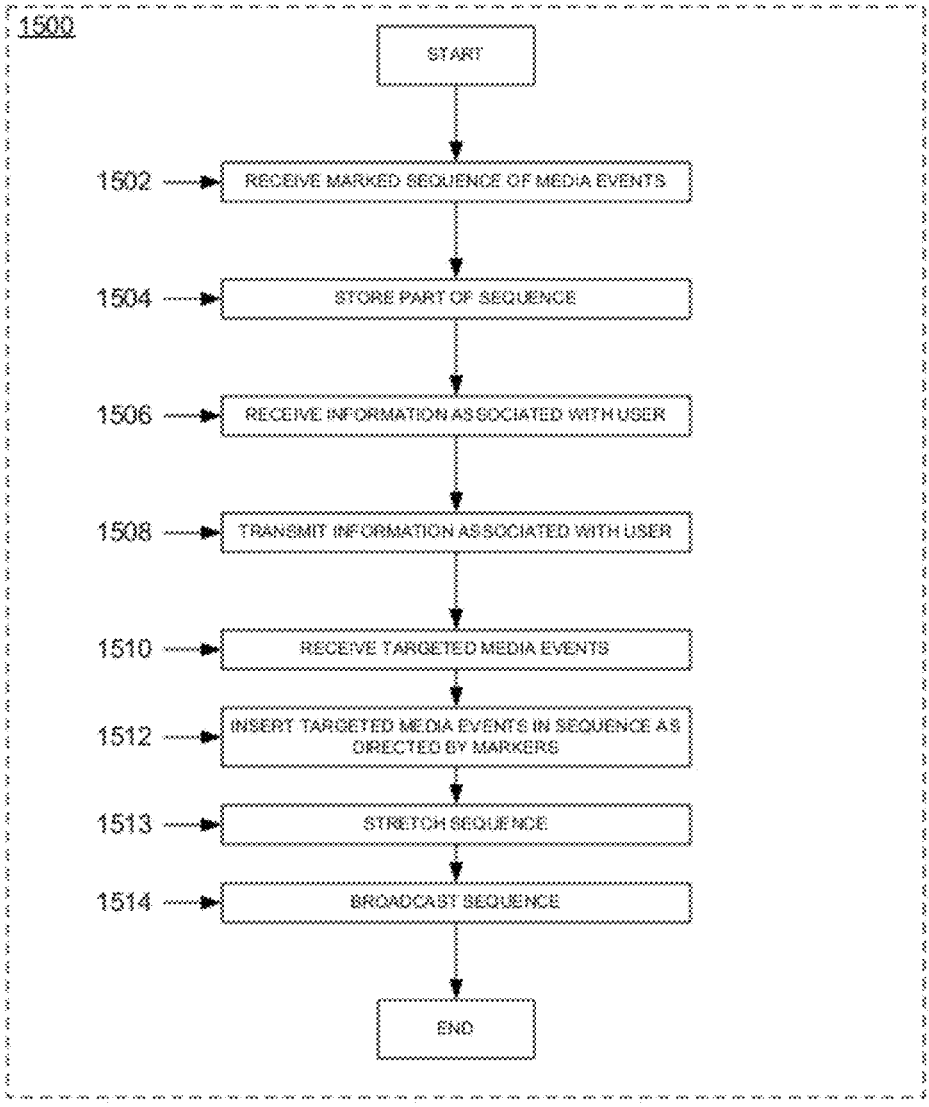
FIG. 15 depicts a flow chart illustrating the process of inserting targeted media events into a sequence of media events that contains insertion markers.

As shown in FIG. 15, a process 1500 of inserting media events, which can include targeted media events, is illustrated and discussed. This process can be performed by a server station, a client server station that is part of a content distribution network (CDN), a client device such as a computer, appliance, personal digital assistant (PDA), wrist watch, stand-alone Internet radio, set top box, and television system, or some other suitable device. In various embodiments, the server station, CDN server, or client device used to implement process 1500 can be located within a receiver.

As shown in block 1502, a secondary audio server receives a first sequence of media events from, for example, a primary audio server. The first sequence of media events can include insertion markers indicating a position within the first sequence of media events targeted media events are to be inserted. The targeted media events can be one of multiple types of media events, including targeted spots or targeted advertisement spots. As shown in block 1504, at least a part of the first sequence of media events can be stored in long term or temporary storage. For example, a CDN server, having received a first sequence of media events, can store at least part of the sequence in a buffer, cache, or other memory.

As shown in block 1506, a server station can receive information associated with a user. A user can include, but is not limited to, a content provider, such as a radio station, or a consumer. The information associated with the user can include, but is not limited to, user demographics such as age, location, and media type preferences. As shown in block 1508, information associated with a user can be transmitted; for example, the information can be transmitted to a tertiary server. The transmission may include information associated with targeted media events, including but not limited to preferred time lengths, or maximum and minimum allowable time lengths. As shown in block 1510, the server can receive targeted media events, which can include, but is not limited to, targeted spots or targeted advertisement spots. Such a receipt of targeted media events can be from the tertiary server. For example, the tertiary server may, in response to receiving information associated with a user, compare the information with a list of advertisement spots and assemble a list of advertisement spots that are targeted to users with similar or matching information; the tertiary server may then transmit the list of targeted advertisement spots to the server station.

As shown in block 1512, the server can be configured to insert targeted media events into the first sequence of media events as directed by insertion markers. The insertion markers may direct the insertion of targeted media events before, after or within a given media event in the first sequence of media events. The first sequence of media events, once modified, becomes a second sequence of media events. The media events inserted can be smart-aware media events. A smart-aware media event can receive information associated with media events preceding and following the smart-aware content media event in the sequence of media events. Upon receiving this information, the smart-aware content media event can provide input to the server with regard as to both which media events should be inserted into the sequence of media events and what parameters should be set for targeted media events.

As shown in block 1513, the server can be configured to stretch (or compress) a sequence of media events. This process of stretching (or compressing) the sequence, illustrated in FIG. 7 and FIG. 10, can be in response to the insertion or removal of media events from the sequence of media events. In other embodiments, the marked sequence of media events received by the server may be shorter than the required time length of the broadcast period, and the server may be configured to stretch (or compress) the sequence of media events to match the required time length of the broadcast period.

As shown in block 1514, the server can be configured to broadcast a sequence of media events; the types of sequences that can be broadcast can include the first sequence of media events and the second sequence of media events.

While the invention has been described with reference to the foregoing embodiments, other modifications will become apparent to those skilled in the art by study of the specification and drawings. For example, the foregoing description may apply in a television, video, and text broadcast context, where the automation playlist may comprise media events of audio and/or visual nature, and the broadcast equipment involve, for example, television broadcasting equipment. Also, the automation play list need not be generated by broadcast automation software, and may simply be an arrangement of media events generated by known music mixing software, such as Adobe Audition. It is thus intended that the following appended claims define the invention and include such modifications as fall within the spirit and scope of the invention.

Various embodiments involving insertion of content and targeted spot insertion at a content distribution network have been discussed. Other variations and modifications of the embodiments disclosed may be made based on the description provided, without departing from the scope of the invention as set forth in the following claims.

What is claimed is:

1. A system for broadcasting media events, the system including at least one server, the server comprising:
- memory; and
- a processor operably associated with the memory and configured to:
  - store at least a portion of a playlist comprising a sequence of media events;
  - identify a gap in the playlist; and
  - generate a modified playlist by delaying or advancing the playback of at least one of the media events in the playlist to fill the gap in the playlist.

2. The system in claim 1, wherein at least one of the sequence of media events is lengthened as long as needed to re-fill a buffer.

3. The system in claim 1, wherein more than one of the sequence of media events are lengthened to fill the gap in the playlist.

4. The system in claim 3, wherein:
- at least two of the more than one media events are lengthened by a similar percentage.

5. The system in claim 3, wherein:
- at least two of the more than one media events are lengthened by a different percentage.

6. The system in claim 1, wherein at least one media event is lengthened and at least one media event is shortened to fill the gap in the playlist.

7. The system in claim 1, the server further comprising:
- an interface configured to transmit the modified playlist to one or more users.

8. A system for broadcasting media events, the system including at least one server, the server comprising:
- a memory configured to store at least a portion of a playlist comprising a sequence of media events;
- a processor coupled to the memory, the processor configured to:
- insert a media event into the playlist to generate a modified playlist; and
- in response to inserting a media event into the playlist, change a rate of playback of at least one of the media events included in the modified playlist.

9. The system in claim 8, wherein at least one of the sequence of media events is shortened in response to inserting a media event into the playlist.

10. The system in claim 8, wherein more than one of the sequence of media events are shortened in response to inserting a media event into the playlist.

11. The system in claim 10, wherein amounts by which the more than one media events are shortened are similar to one another.

12. The system in claim 10, wherein an amount by which at least one of the more than one media events is shortened is different from an amount by which at least another of the more than one media events is shortened.

13. The system in claim 8, wherein at least one media event is lengthened and at least one other media event is shortened in response to inserting a media event into the playlist.

14. The system in claim 8, the server further comprising:
- an interface configured to transmit the modified playlist to one or more users.

15. A method comprising:
- storing at least a portion of a playlist comprising a sequence of media events on a content distribution (CDN) server;
- editing a first media event; and
- in response to editing the first media event, changing a length of another one or more media events in the playlist to generate a modified playlist.

16. The method of claim 15, wherein editing the first media event comprises:
- removing at least a portion of content from the first media event; and
- lengthening the first media event to extend a playback length of the first media event.

17. The method of claim 15, wherein:
- editing the first media event includes removing at least a portion of content from the first media event; and
- changing the length of the another one or more media events in the playlist includes lengthening at least a second media event to extend a playback length of the at least a second media event to compensate for removing the at least a portion of content from the first media event.

18. The method of claim 15, wherein editing the first media event includes inserting additional content into the first media event to generate a modified first media event.

19. The method of claim 15, wherein:
- editing the first media event includes inserting additional content into the first media event; and wherein
- changing the length of another one or more media events in the playlist includes shortening at least a second media event.

20. The method of claim 15, further comprising:

transmitting the modified playlist to one or more users.

21. A system for broadcasting media events, the system comprising:

at least one processor configured to implement a first server, the first server configured to:

store a first playlist including a first media item and a second media item, wherein the first media item and the second media item are to be broadcast in sequence;

remove at least a first portion of the first media item;

replace the first portion of the first media item with the second media item, thereby creating a first modified playlist;

broadcast the first modified playlist; and the at least one processor configured to implement a second server, the second server configured to:

broadcast the first playlist concurrently with the first server broadcasting the first modified playlist.

22. The system in claim 21, wherein the first portion of t le first media item includes the entire first media item.

23. The system in claim 21, wherein at least a portion of a first processor of the at least one processor forms at least a portion of a second processor of the at least one processor.

24. A system for broadcasting media events, the system including at least one server, the server comprising:

a first memory; and a first processor operably associated with the first memory and configured to:

identify a gap in the playlist, wherein the gap is defined by a lack of content;

store a first media content in the first memory, the playback time of the first media content is substantially similar to the gap in the playlist; and broadcast the first media content during the gap in the playlist;

a second memory;

a second processor operably associated with the second memory and configured to:

store a second media content in the second memory, the playback time of the second media content is substantially similar to the gap in the playlist; and broadcast the second media content during the gap in the playlist concurrently as the first processor broadcasts the first media content during the gap in the playlist.

25. The system of claim 24, wherein at least the first or second media content is an advertisement.

26. The system of claim 24, wherein at least the first or second media content is a predetermined portion of the playlist.

* * * * *